United States Patent [19]

Jan

[11] Patent Number: 4,823,432

[45] Date of Patent: Apr. 25, 1989

[54] DEVICES FOR STOPPING SWINGING DOORS

[76] Inventor: Cow M. Jan, No. 39-3, Aelly 350, Li Zen Rd., Tainan, Taiwan

[21] Appl. No.: 152,541

[22] Filed: Feb. 5, 1988

[51] Int. Cl.[4] ..... E05F 5/00

[52] U.S. Cl. ..... 16/86 A; 16/DIG. 10; 16/DIG. 17; 16/DIG. 21; 292/DIG. 15

[58] Field of Search ..... 16/85, 86 R, 86 A, DIG. 10, 16/DIG. 17, DIG. 21; 292/DIG. 4, DIG. 15, 180

[56] References Cited

U.S. PATENT DOCUMENTS

| | | | |
|---|---|---|---|
| 224,092 | 2/1880 | Kidney | 292/180 |
| 976,597 | 11/1910 | Prevost | 292/DIG. 15 |
| 1,100,475 | 6/1914 | Franckaerts | 292/DIG. 15 |
| 1,157,376 | 10/1915 | Franckaerts | 292/DIG. 15 |
| 1,237,030 | 8/1917 | Haas | 292/DIG. 15 |
| 1,246,992 | 11/1917 | Parsons | 292/DIG. 15 |
| 1,300,912 | 4/1919 | Yarberry | 292/DIG. 15 |
| 1,443,570 | 1/1923 | Franckaerts | 292/DIG. 15 |
| 4,686,740 | 8/1987 | Ishii | 16/85 |

*Primary Examiner*—Fred Silverberg
*Assistant Examiner*—Edward A. Brown
*Attorney, Agent, or Firm*—Morton J. Rosenberg

[57] ABSTRACT

A device which allows a choice of stopping positions for a swinging door mainly comprises a body having a cylindrical well together with a passage hole vertically formed through the body, an operation means includes a plunger normally supported by a spring, a friction body received under the plunger. Said plunger can be plunged repetitively between a suspension position where the friction body is suspended properly above the ground and a stop position where the friction body is pushed in association with the plunger to touch the ground to stop the door at a selected position through friction effected between the friction body and the ground.

1 Claim, 4 Drawing Sheets

DEVICES FOR STOPPING SWINGING DOORS

BACKGROUND OF THE INVENTION

This invention relates to a device for stopping a swinging door, particularly to a device for free stopping a swinging door within the range of its movement.

Generally, a swinging door can be opened and kept at the utmostly opened position with a receiving head perpendicularly fixed to the back of a door to be received by a receiver correspondingly fixed on a wall. Sometimes, the room door, such as a baby's room, in a house is preferred to be slightly or properly opened for detecting the situation therein and preventing unnecessary disturbances which may frighten the sleeping baby inside. It is found that the position of the room door slightly or properly opened as necessary can not be stably kept in position and can probably be swung close with a slam by a wind or other unexpected forces.

SUMMARY OF THE INVENTION

It is accordingly a primary object of this invention to provide a device which allows free choice of stopping a swinging door within the range of its movement to overcome the foregoing defects associated with prior art.

According to the present invention, this and other objects achieved by providing a device mainly comprises a body, a control means and an operation means mostly arranged in the body. The body has a cylindrical well vertically formed, a passage hole vertically extending from the bottom of the cylindrical well through the remainder of the body and a port horizontally communicating with the cylindrical well. The operation means includes a plunger, which is normally supported upwardly by a spring, slidable in the cylindrical well, a friction body made of flexible and frictional materials, such as rubber, and disposed under the plunger. The control means provides a guiding groove located within the scope of said port. The guiding groove has a higher first stop position and a lower second position. One end of a pin which is received by the plunger is engaged in the guiding groove, and moved in association with the plunger between said two positions thereof to correspondingly offer the operation means a suspension position and a stop position. While the operation means is plunged to the stop position, the friction body is pushed to touch the ground to stop the door at a selected position through the friction effected between the friction body and the ground.

DETAILED DESCRIPTION OF THE PREFERRED EMBODIMENT

Figure 1:
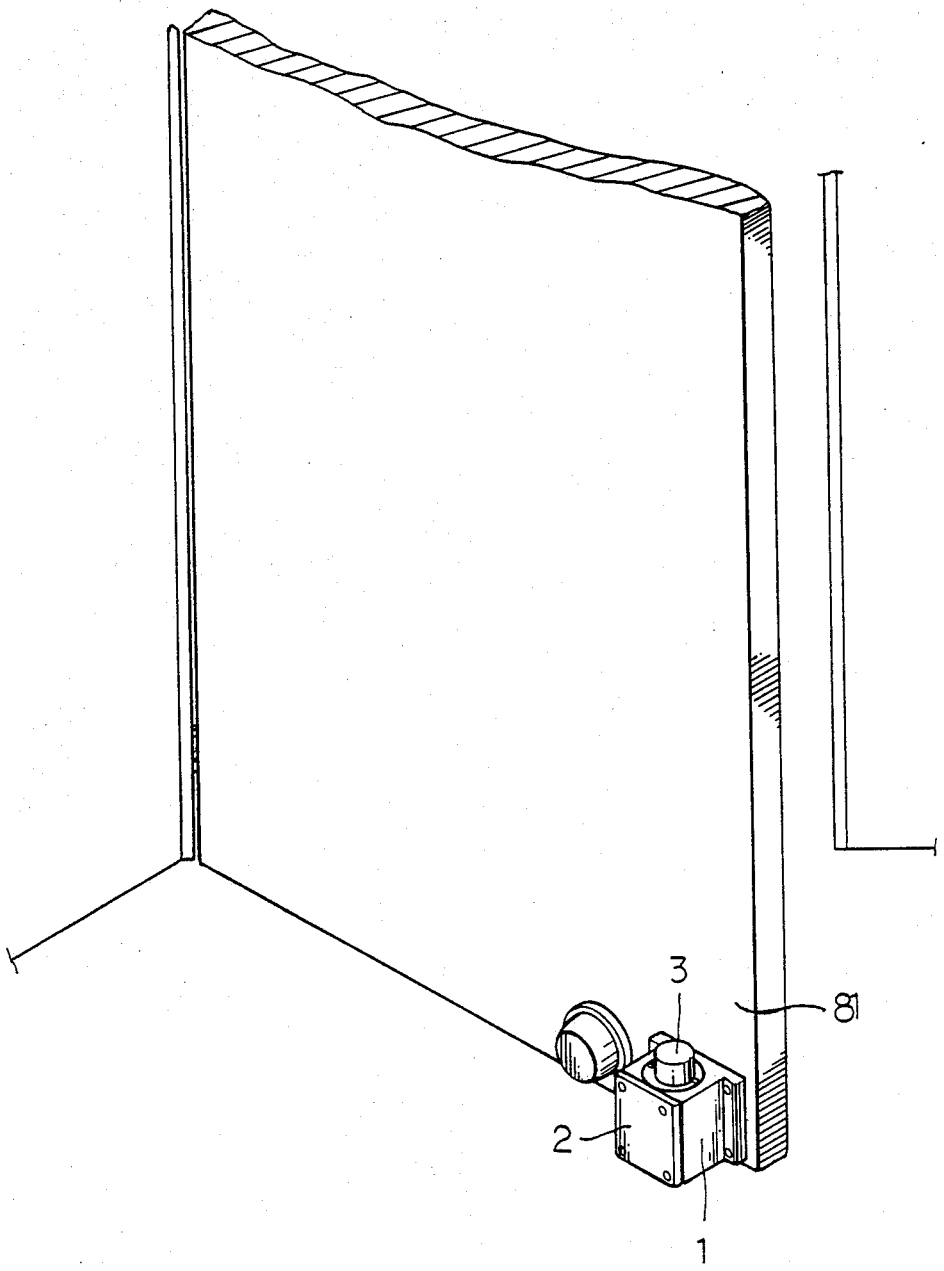
FIG. 1 is a perspective view of a device embodying the present invention, which is disposed in a corner of a door.
Figure 2:
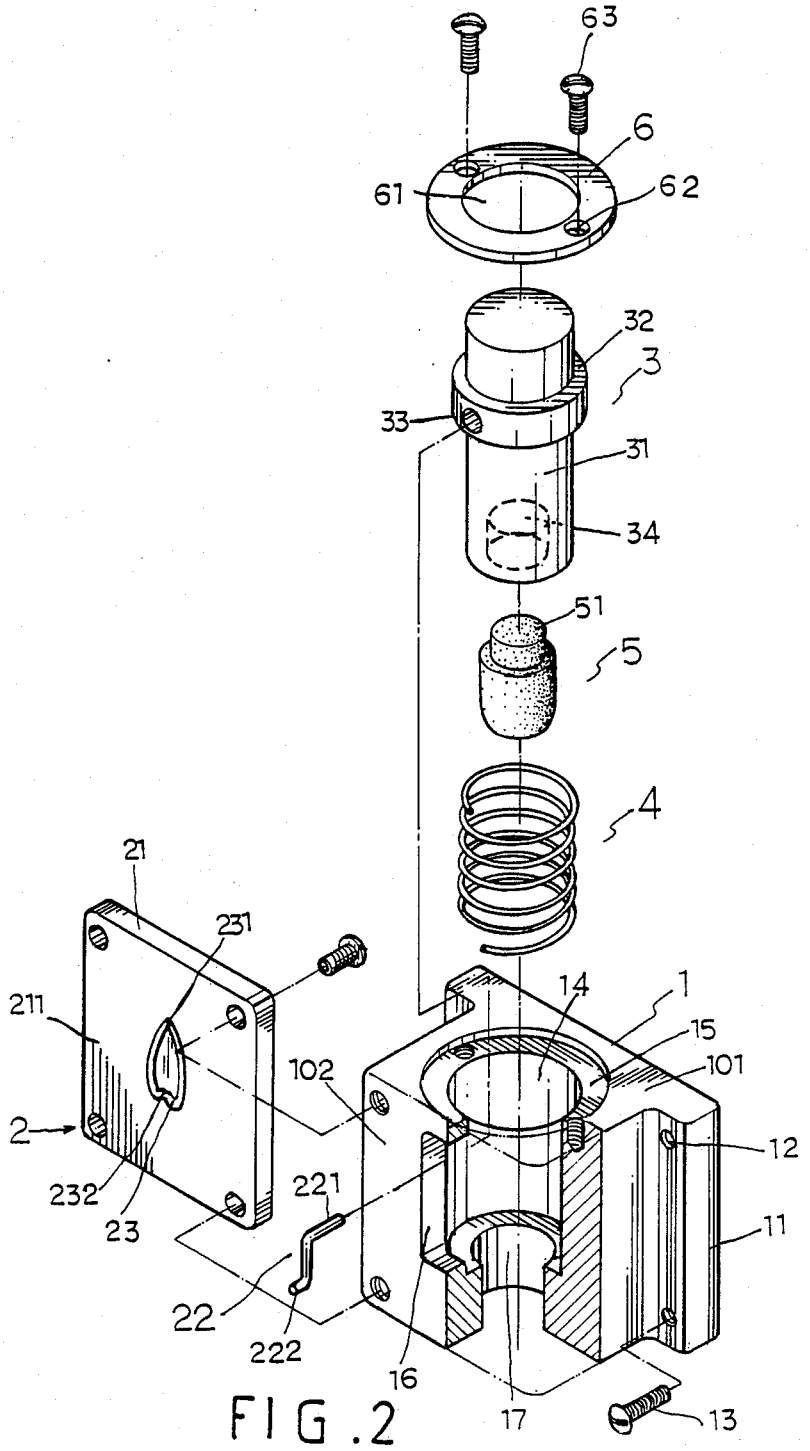
FIG. 2 is an exploded perspective view of a device for stopping a swinging door embodying the present invention.
Figure 3:
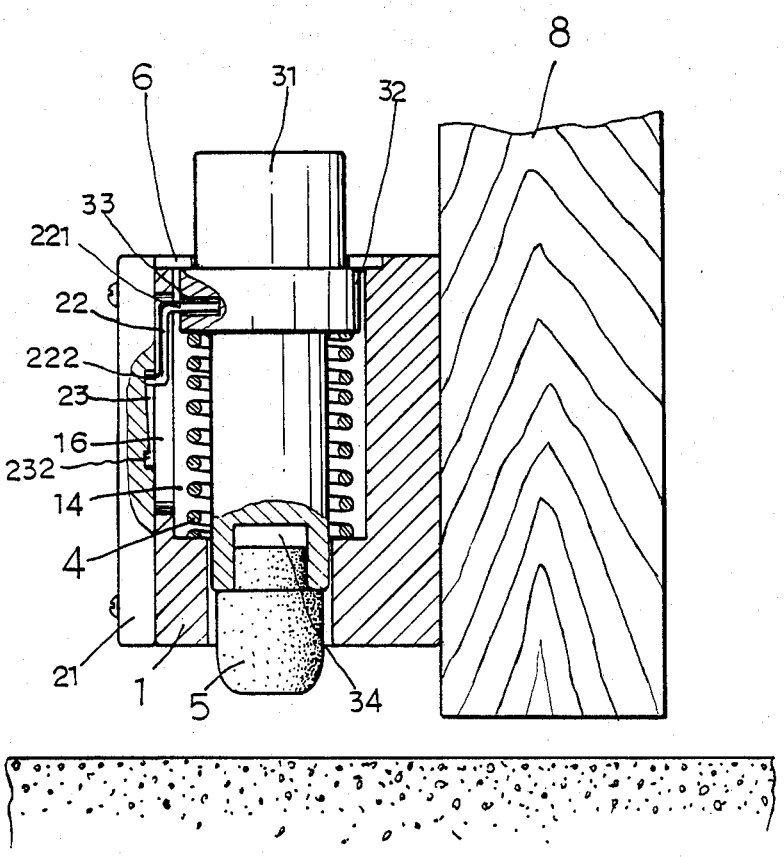
FIG. 3 is a partially sectional view of a device for stopping a swinging door embodying the present invention which is disposed on a door while locating the operation means at a suspension position.

Referring to FIGS. 1, 2 and 3, the device for stopping a swinging door according the present invention is disposed on the very low part of a door 8, and it is preferable to be disposed in the outer corner of the door back 81. Said device mainly comprises a body 1, a control means 2 and an operation means 3 mostly arranged in the body 1.

The body 1 has a pair of flanges 11 having fixing holes 12 evenly located therein for disposing the body 1 to the door 8 by means of screws 13. A cylindrical well 14 having a uniform inner diameter is vertically formed in the body 1 in conjunction with a shallow hole 15 which is formed on the top side 101 of the body 1. A passage hole 17 vertically extends from the bottom of the cylindrical well 14 to the bottom of the body 1. A port 16 communicating with the cylindrical well 14 is formed in the side wall 102 of the body 1.

The control means 2 includes a cover plate 21, which has a guiding groove 23 running in a side surface 211 thereof, is to be mounted on the side wall 102 of the body for locating the groove 23 within the scope of the port 16. A pin 22 having two parallel ends 221, 222 is provided to be moved repetitively in association with the operation means 3. The parallel end 222 is engaged in the groove 23 and can be moved between the first stop position 231 and the second stop position 232 along the guiding groove 23.

The operation means 3 includes a plunger 31 having a flange 32 provided on the upper peripheral surface, and a recess 34 (shown as the phantom lines in FIG. 2) formed in the end portion for receiving the head portion 51 of a friction body 5 made of flexible and frictional materials, such as rubber. A hole 33 is substantially horizontally formed in the flange 32 for receiving the other parallel end 221 of the pin 22. A spiral spring 4 is disposed about the plunger 31 under the flange 32, and further limited between the bottom of the cylindrical well 14 and the flange 32 of the plunger 31 when both of the spiral spring 4 and the plunger 31 are inserted into the cylindrical well 14. A fixing ring 6 having an opening 61 formed in the central portion thereof for receiving the plunger 31 above the flange 32 and extruding it for operation, is engaged with the shallow recess 15 and further fixed on the body 1 by means of screws 63 to keep the operation means 3 in position in the cylindrical well 14 of the body 1, and the friction body 5 received by the plunger 31 is correspondingly suspended above the ground while the parallel end 222 of the pin 22 stays at the first stop position 231 of the guiding groove 23.

Figure 4:
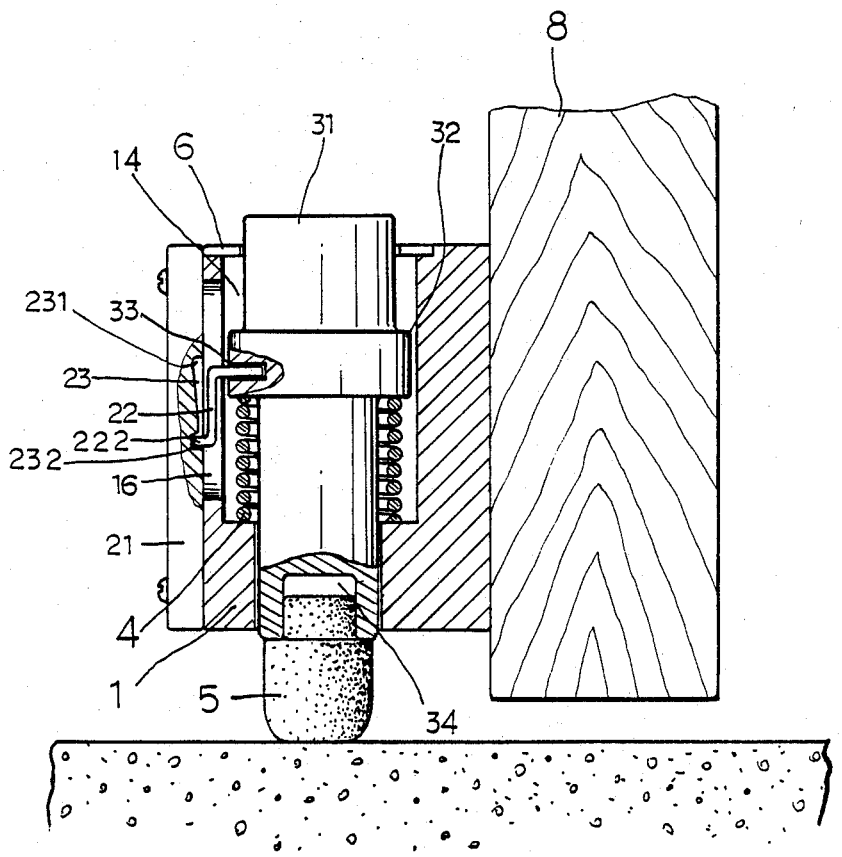
FIG. 4 is a partially sectional view of a device for stopping a swinging door embodying the present invention which is disposed on a door while locating the operation means at a stop position.

Referring to FIG. 4, the plunger 31 can be plunged by force from a suspension position (as shown in FIG. 3) to a stop position while the parallel end 222 of the pin 22 is moved in association with the plunger 31 from the first stop position to the second stop position 232 of the guiding groove 23. In the meantime, the friction body 5 is pushed to touch the ground to stop the door 8 at a selected position within its movement, and said stop is achieved through the friction effected between the friction body 5 and the ground. The plunger 31 can resume its suspension position by pushing the plunger 31 to move in association with the pin 22 to leave the second stop position 232, and automatically return to the first stop position.

It will be appreciated, of course, that although a particular embodiment of the invention has been described, modification may be made. It is intended in the following claim to cover all modifications which all within the scope of the invention.

What is claimed is:

1. A door stop system fixedly secured to a door and adapted to frictionally engage a floor surface to maintain said door is fixed position with respect to said floor surface, comprising:

a body housing having a vertically directed cylindrical well formed therein, said well extending from an upper surface of said body housing, said body housing including a passage hole extending from a lower surface of said body housing in open communication with said cylindrical well, said cylindrical well and said passage hole defining a shoulder at an interface therebetween, said body housing including a port formed through a sidewall thereof in open communication with said cylindrical well;

a control member fixedly secured to said sidewall of said body housing, said control member having a guiding groove formed therein, said guiding groove defining a substantially heart-shaped closed contour having a first stop position at an apex of said guiding groove and a second stop position at a lower end of said guiding groove, said guiding groove in communication with said port;

a pin member having a pair of displaced substantially parallel end portions, one of said end portions of said pin member being displaceably engaged within said guiding groove; and, operational displacement means for controlling frictional engagement with said floor surface, said operational displacement means including a plunger member slideably displaceable within said cylindrical well, said plunger member having an upper end extending above said body housing upper surface, said plunger member further including a horizontally directed recess for receiving said other end of said pin member, said operational displacement means further including a friction member secured to a lower end of said plunger member for frictionally engaging said floor surface when said pin member is displaced to said second stop position and a spring member for biasing said plunger member in an upward direction, said operational displacement means being maintained within said body housing.

* * * * *